US008766769B2

(12) United States Patent
Lange

(10) Patent No.: US 8,766,769 B2
(45) Date of Patent: Jul. 1, 2014

(54) LATCH OPERATING SYSTEM AND INSTRUCTION METHOD

(75) Inventor: Richard J. Lange, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 239 days.

(21) Appl. No.: 13/403,772

(22) Filed: Feb. 23, 2012

(65) Prior Publication Data

US 2013/0219974 A1 Aug. 29, 2013

(51) Int. Cl.
*G08C 19/00* (2006.01)

(52) U.S. Cl.
USPC ..... 340/5.61

(58) Field of Classification Search
USPC ..... 340/5.72, 5.61; 307/10.1
See application file for complete search history.

(56) References Cited

U.S. PATENT DOCUMENTS

2001/0022549 A1* 9/2001 Mauel et al. ..... 340/5.72
2002/0093418 A1* 7/2002 Schmitz et al. ..... 340/5.62
2008/0127926 A1* 6/2008 Kim ..... 123/179.2

* cited by examiner

*Primary Examiner* — Vernal Brown

(57) ABSTRACT

A user is authorized to enter a side door in a vehicle having a rear closure by a method including: providing a door latch having an electric actuator energizable to unlatch the door latch; providing a rear closure latch that is unlatched by either a key operated lock cylinder or energization of an electrical actuator; providing a fob for transmitting a first radio signal indicating that a user is authorized to unlatch the door latch and a second radio signal energizing the rear closure latch; monitoring the transmission of the radio signals; monitoring the status of the closure latch to determine that the closure latch has been unlatched; and if the closure latch has been unlatched without the transmission of the second radio signal, calculating that the key was used, the user is authorized; and operating the door latch to permit user entry through the side door.

19 Claims, 3 Drawing Sheets

LATCH OPERATING SYSTEM AND INSTRUCTION METHOD

FIELD OF THE INVENTION

The present invention provides entry through the locked side door of a vehicle without the use of a remote entry fob, or the use of a key cylinder or key pad on the side door.

BACKGROUND OF THE INVENTION

The term "door latch" used herein refers to the mechanism mounted on the edge of a vehicle door which engages with a striker mounted on the door frame in order to "latch" the door in the closed position. The terms "unlatching" and "unlatch" refer to operating the door latch in a manner to disengage from the striker so the door can be swung open. The term "locking" refers to operating the door latch so that it cannot be opened from outside the vehicle by an unauthorized person. The term "unlocking" refers to operating the door latch so that the door latch can be readily unlatched from outside the vehicle by any person.

Modern motor vehicles have a remote entry fob carried by the driver for operating the side door latch from a distance. In some vehicles, the radio frequency signal from the fob will merely unlock the door latch so that the user can lift a door handle to unlatch the door latch. In other vehicles, the radio frequency signal from the fob will unlatch the door latch so that the energy stored in the weather strip will pop the door open without the user having to lift a door handle.

A problem with the use of a fob to operate the latch, by either unlocking a door latch or unlatching the door latch, is that the fob can fail to work if the battery is weak or the fob becomes damaged, for example by moisture. When the fob fails, the user will enter the vehicle by using a key to unlock the door latch via a key cylinder mounted on the side door. Or in some cases, the side door will have a digital key pad for unlocking the door.

It would be desirable to improve the aesthetics and reduce the cost of the vehicle by eliminating the need for either a key cylinder or key pad on the side door. However, this would leave the user unable to gain entry to the locked vehicle in the event of failure of the fob.

Accordingly, the present invention provides a new and improved method for operating a side door latch without the use of either a fob or a key cylinder or a key pad mounted on the side door.

In addition, because of the challenge of training vehicle users to understand the nuances of a new door latch control system, it would be desirable to provide an improved method for instructing the vehicle user as to the nature of the problem that has occurred and giving the user advice as to how to repair the problem. In particular, the driver should be advised to seek a repair of the fob.

SUMMARY OF THE INVENTION

A method is provided for authorizing a user to enter a side door in a vehicle having a rear closure. The method includes providing the side door with a side door latch having an electric actuator energizable to unlatch the side door latch; providing the rear closure with a rear closure latch that is unlatched by either a key operated lock cylinder operable by a properly bitted key or energization of an electrical actuator; providing a wireless fob for transmitting a first radio signal indicating that a user is authorized to unlatch the side door latch and a second radio signal energizing the rear closure latch; monitoring the transmission of the first and second radio signals; monitoring the status of the rear closure latch to determine that the rear closure latch has been unlatched; and if the rear closure latch has been unlatched without the transmission of the second radio signal, then the key was used and the user must therefore be authorized; and operating the side door latch to permit user entry through the side door.

Further areas of applicability of the present invention will become apparent from the detailed description provided hereinafter. It should be understood that the detailed description and specific examples, while indicating exemplary embodiments of the invention, are intended for purposes of illustration only and do not limit the scope of the invention.

BRIEF DESCRIPTION OF THE DRAWINGS

The present invention will become more fully understood from the detailed description and the accompanying drawings.

DETAILED DESCRIPTION OF THE EXEMPLARY EMBODIMENTS

The following description of certain exemplary embodiments is merely exemplary in nature and not intended to limit the invention, its application, or uses.

Figure 1:
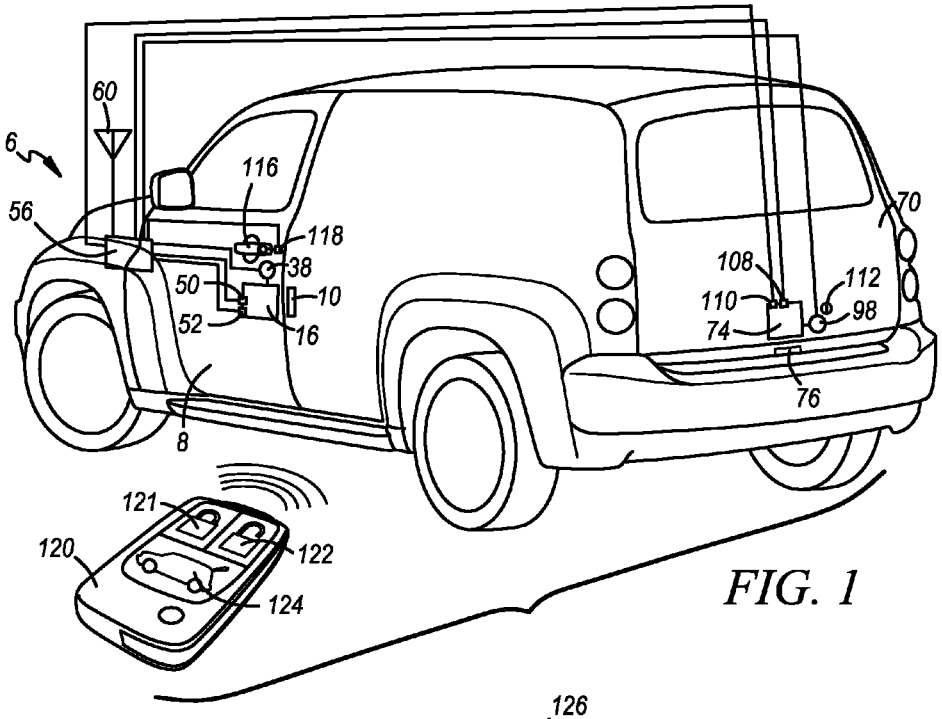
FIG. 1 is a perspective view of a vehicle having a door latch operating system according to the invention.

Referring to FIG. 1, a motor vehicle 6 includes a side door 8 mounted on hinges for swinging movement between the closed position, shown in FIG. 1, and an open position. A door latch 16 is mounted on the side door 8 and latches with a striker 10 mounted on the motor vehicle 6 to latch the side door 8 in the closed position.

The Door Latch

Figure 2:
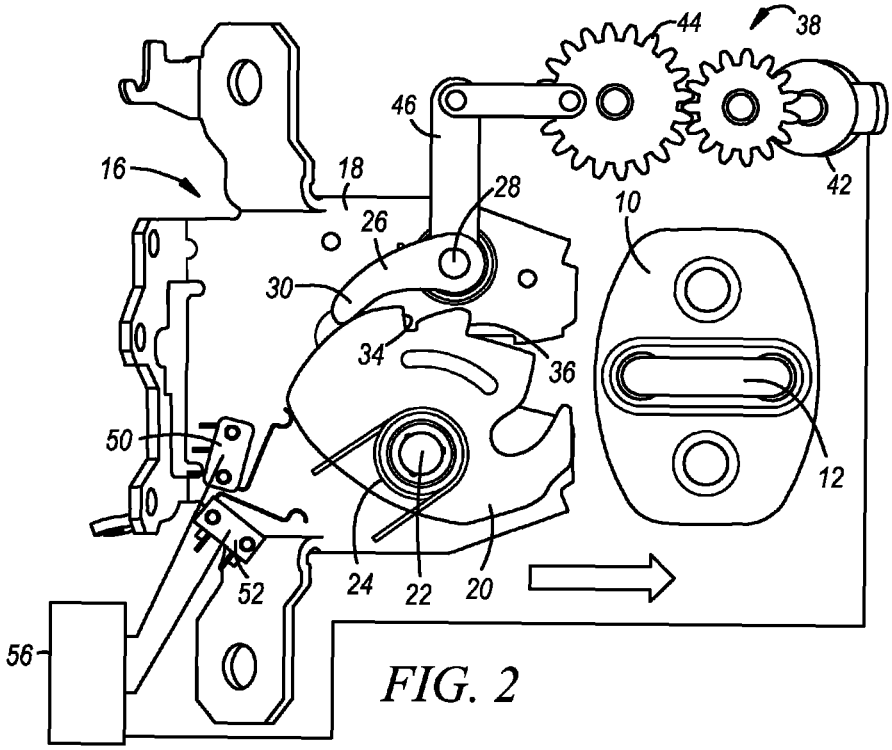
FIG. 2 is a view of a side door latch shown in the unlatched position.

As seen in FIGS. 1 and 2, the striker 10 is mounted on the motor vehicle 6 and includes a striker pin 12. The side door latch, generally indicated at 16, includes a housing 18 mounted on the rear edge of the side door 8. A fork bolt 20 is mounted on housing 18 by a pivot 22 so that the fork bolt 20 can rotate between an unlatched position, shown in FIG. 2, a partial or secondary latched position, shown in FIG. 3, and a fully latched or primary latched condition, shown in FIG. 4. The fork bolt 20 is biased clockwise toward the unlatched position of FIG. 2 by a fork bolt spring 24. A latching lever 26 is mounted on the housing 18 by a pivot 28. The latching lever 26 has a tooth 30 that engages with fork bolt 20.

In FIG. 2, the side door 8 is open and the door latch 16 is spaced away from the striker 10. The tooth 30 of the latching lever 26 is resting on the fork bolt 20 and the fork bolt 20 is in its unlatched position.

Figure 3:
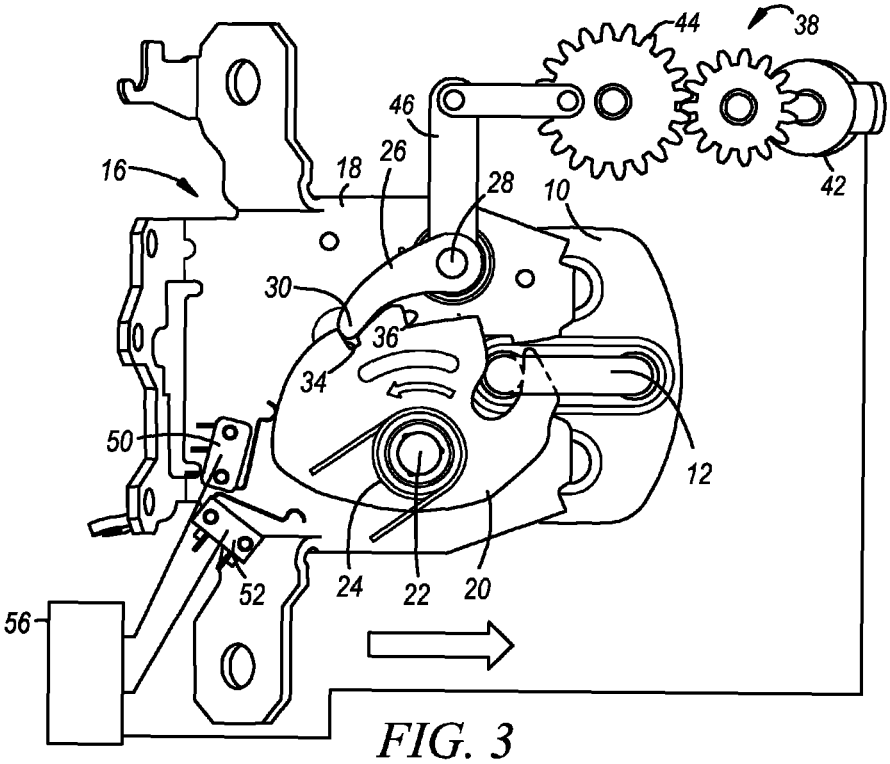
FIG. 3 is a view similar to FIG. 2 but showing the side door latch in the secondary or partially latched position.

In FIG. 3, the side door 8 has moved in the closing direction and fork bolt 20 has rotated about its pivot 22 and become engaged with the striker pin 12 of striker 10. This rotary movement of the fork bolt 20 has allowed the tooth 30 of the latching lever 26 to engage with a secondary latching surface 34 of the fork bolt 20. Although the side door 8 has not reached its fully closed position, the side door 8 cannot be reopened until the latching lever 26 is pivoted away from the fork bolt 20.

Figure 4:
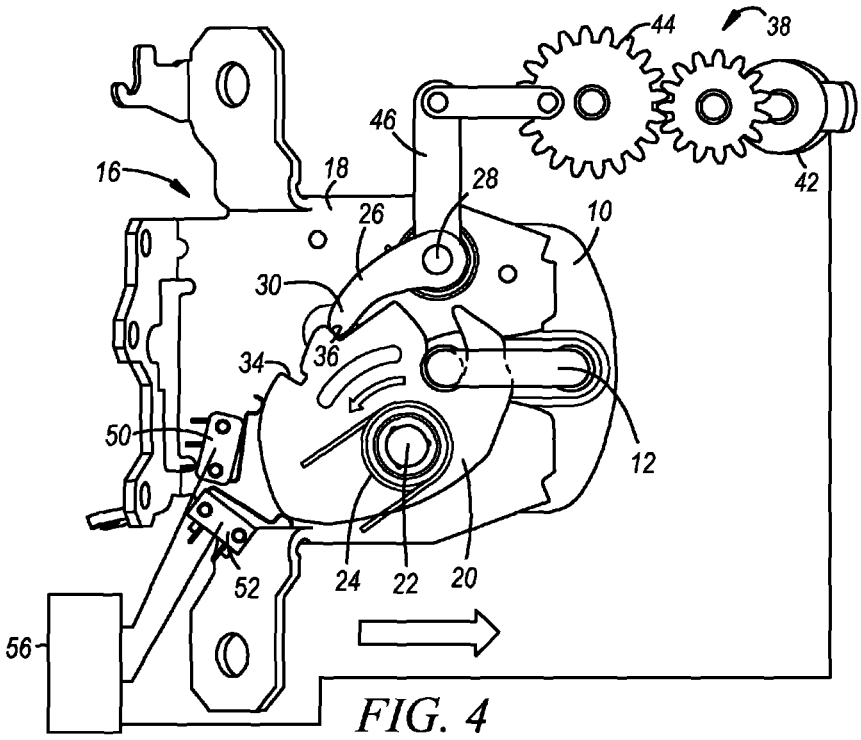
FIG. 4 is a view similar to FIGS. 2 and 3 but showing the side door latch in the primary fully latched position.

In FIG. 4, the side door 8 has been successfully moved to the fully closed position and striker pin 12 has induced a further rotation of the fork bolt 20 against the bias of the fork bolt spring 24 so that the fork bolt 20 has reached its fully latched position. In the fully latched position of FIG. 4, the latching lever 26 has rotated into engagement with a primary latching surface 36 of the fork bolt 20. Thus, the side door 8 is latched in its fully closed position and the door latch 16 will remain latched until unlatched by a vehicle user.

As seen in FIGS. 1, 2, 3, and 4, the door latch 16 includes an electrical actuator 38 that can be energized in order to unlatch the door latch 16 to permit the side door 8 to swing to the open position of FIG. 1. In particular, as seen in FIGS. 2, 3, and 4, the electrical actuator 38 includes motor 42 and a gear drive 44. The gear drive 44 is suitably connected to a lever 46 which is in turn connected to the latching lever 26. When the motor 42 is energized, the latching lever 26 will be rotated clockwise in the direction away from the fork bolt 20, thereby lifting the tooth 30 away from engagement with the fork bolt 20. Upon disengagement of the latching lever 26 from the primary latched condition of FIG. 4, the side door 8 will be popped open and away from engagement with the striker 10 by the combined effort of the fork bolt spring 24 and the spring force that is stored within the elastic weather strip that seals the side door 8 and engages with the door opening of the motor vehicle 6. The user can then swing the side door 8 open to enter the motor vehicle 6.

As seen in FIGS. 2, 3, and 4, the door latch 16 is provided with a microswitch 50 and a microswitch 52 that are positioned to be operated by the fork bolt 20. For example, in FIG. 2, the door latch 16 is in the unlatched position and microswitch 50 is open and microswitch 52 is open. In FIG. 3, the fork bolt 20 is in the secondary latched position, and microswitch 50 is closed and microswitch 52 is open. In FIG. 4, the fork bolt 20 is in the fully latched position and microswitch 50 is closed and microswitch 52 is closed. Monitoring the position of the microswitches 50 and 52 will indicate whether the rear closure latch 74, shown in FIG. 1, is in the position of FIG. 2, 3, or 4. The microswitches 50 and 52 are electrically connected to a control module 56, as will be discussed hereinafter.

The Rear Closure Latch

Referring again to FIG. 1, the motor vehicle 6 also has a rear closure 70 mounted on hinges for swinging movement between the closed position, shown in FIG. 1, and an open position. Rear closure 70 can be a trunk lid that closes a luggage compartment or a closure hatch that closes the cargo compartment in a sport utility type vehicle. The rear closure 70 is normally latched in the closed position of FIG. 1 by closure latch 74 mounted on the rear closure 70 that engages with a striker 76 mounted on the rear sill of the motor vehicle 6.

Figure 5:
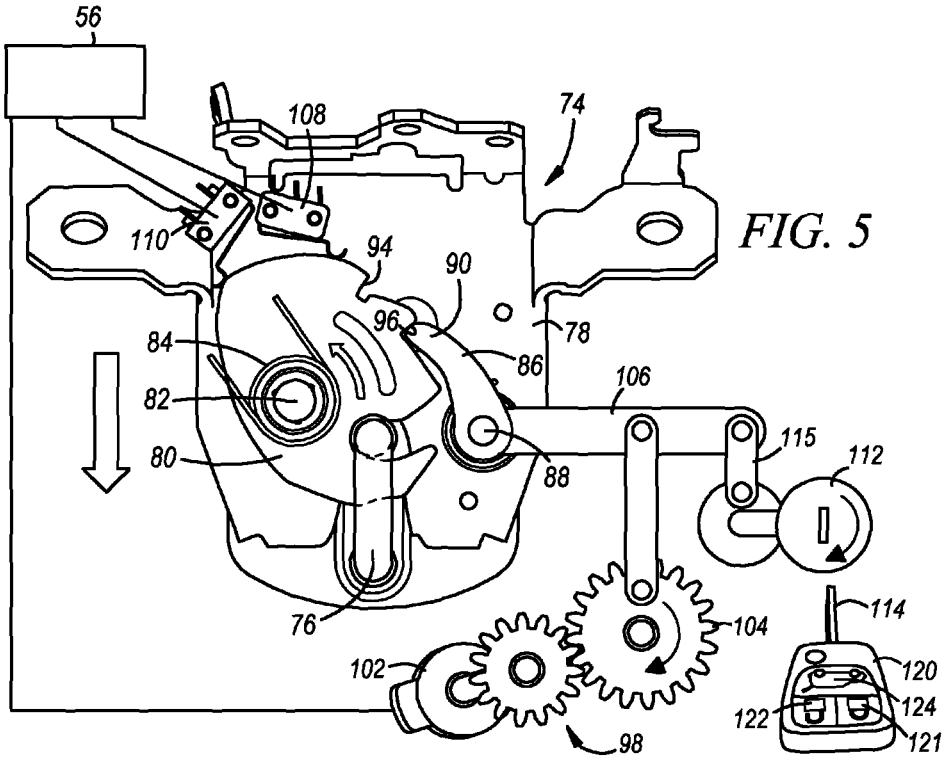
FIG. 5 is a view of a rear closure latch shown in the primary fully latched position.

The closure latch 74 is generally similar to the door latch 16 previously described herein for latching the side door 8. As seen in FIG. 5, the closure latch 74 includes a housing 78 mounted on the rear closure 70. A fork bolt 80 is mounted on housing 78 by a pivot 82 so that the fork bolt 80 can rotate between a primary latched position, shown in FIG. 4, a secondary latched position, similar to that shown in FIG. 2, and an unlatched position, similar to that shown in FIG. 1. The fork bolt 80 is biased clockwise toward the unlatched position by a fork bolt spring 84. A latching lever 86 is mounted on the housing 18 by a pivot 88. The latching lever 86 has a tooth 90 that engages with fork bolt 80.

In FIG. 5, the rear closure 70 has been successfully moved to the fully closed position and the striker 76 has induced rotation of the fork bolt 80 to the fully latched position in which the latching lever 86 has passed over a secondary latching surface 94 of the fork bolt 80 and engaged with primary latching surface 96.

The closure latch 74 includes an electrical actuator, generally indicated at 98, that can be energized in order to unlatch the closure latch 74 to permit the rear closure 70 to swing upwardly to an open position. Electrical actuator 98 includes a motor 102 and a gear drive 104. Gear drive 104 is suitably connected to a lever 106 which is in turn connected to the latching lever 86. When the motor 102 is energized, latching lever 86 will be rotated clockwise in the direction away from the fork bolt 20, thereby lifting the tooth 90 away from engagement with the fork bolt 80. Upon disengagement of the latching lever 26 from the primary latching surface 96, the rear closure 70 will be popped open and away from the striker 76 by the combined effort of the fork bolt spring 84 and the spring force that is stored within the elastic weather strip that surrounds the rear closure 70. The user can then lift the rear closure 70 to the full open position.

As seen in FIG. 5, the closure latch 74 is provided with a microswitch 108 and a microswitch 110 that are positioned to be operated by the fork bolt 80. Monitoring the position of the microswitches 108 and 110 will indicate whether the closure latch 74 is in the latched position of FIG. 5, or the unlatched position obtained when the latch is released from engagement with the striker 76. The microswitches 108 and 110 are electrically connected to control module 56, as will be discussed hereinafter.

Referring again to FIG. 5, it is seen that the rear closure 70 is also provided with a key cylinder 112 for unlatching the closure latch 74. The key cylinder 112 can be rotated by a properly bitted key 114 and rotation of the key cylinder 112 will pull downwardly on link 115 to rotate the lever 106. Accordingly, it will be understood that there are two ways to actuate the lever 106 and thereby unlatch the closure latch 74. In particular, either the electrical actuator 98 can be energized, or the key 114 can be inserted to rotate the key cylinder 112 in order to unlatch the closure latch 74.

The Control Module and Antenna

Referring again to FIG. 1, it is seen that the vehicle is equipped with a central computerized body control module 56 for monitoring the status of the vehicle body latching systems and controlling the operation thereof. The control module 56 is electrically connected with the electrical actuator 38 of the side door latch 16, and also electrically connected with the electrical actuator 98 of the rear closure latch 74. Thus, the control module 56 can operate the side door latch 16 and the rear closure latch 74.

In addition, the control module 56 is electrically connected with the microswitches 50 and 52 of the side door latch 16 and the microswitches 108 and 110 of the rear closure latch 74. Thus, the control module 56 can monitor the positions of the fork bolt 20 in the side door latch 16 and the fork bolt 80 in the rear closure latch 74, and thereby know whether the side door 8 and rear closure 70 are open or closed.

The Door Handle and Remote Entry Fob

The motor vehicle 6 is also provided with a door handle 116 having a switch 118 that is electrically connected with the control module 56. Thus, when the door handle 116 is lifted by a vehicle user, the control module 56 is informed that the user wishes to enter the vehicle.

In addition, as seen in FIG. 1, the vehicle is equipped with a remote keyless entry fob 120 for authorizing entry to the vehicle. The fob 120 contains a radio frequency transmitter that communicates with an antenna 60 connected to the control module 56. The fob 120 has a button 121 for locking the side door latch, a button 122 for unlocking the side door latch 16, and a button 124 for unlocking the rear closure latch 74. The key 114 is hidden and stored within the fob 120 and ejects therefrom when needed, as seen in FIG. 5.

Normal Side Door Entry with Keyless Entry Fob

In FIG. 1, the door latch 16 is in its latched condition of FIG. 3. When the vehicle user approaches the vehicle from a distance, the user will push the button 122 of the fob 120, thereby informing the control module 56 that the user is authorized to enter the vehicle. Then, when the user lifts the door handle 116, the control module 56 will energize the actuator 38 which rotates the latching lever 26 out of engagement with the fork bolt 20 and the combined effort of the fork bolt spring 24 and the energy stored in the compression of the weather strip surrounding the door will pop the side door 8 open.

If the user has not pushed the button 122, the control module 56 will not energize the actuator 38 in response to the lifting of the door handle 116 by the user. Thus, in effect, the side door latch 16 remains latched and locked until the signal is received from the fob 120 so that an unauthorized person cannot gain entry into the vehicle by lifting the door handle 116.

In addition, as seen in FIG. 1, the side door 8 does not have a key operated lock cylinder or an electronic key pad for unlocking the door latch 16. Thus, in FIG. 1, the side door 8 is aesthetically and aerodynamically improved by the absence of protruding hardware, such as the key cylinder or key pad. However, if the fob 120 is inoperative, due to a weak battery or moisture damage, the door latch 16 cannot be operated and the vehicle cannot be entered.

Normal Rear Closure Entry with Keyless Entry Fob

Referring again to FIG. 1, it is seen that the fob 120 has a rear closure release button 124. Pressing the rear closure release button 124 will transmit a radio signal to the antenna 60 and the control module 56 will then energize the electrical actuator 98 to unlatch the closure latch 74. Upon disengagement of the latching lever 26 from the primary latching surface 96, the rear closure 70 will be popped open and away from the striker 76 by the combined effort of the fork bolt spring 84 and the spring force that is stored within the elastic weather strip that surrounds the rear closure. The user can then lift the rear closure 70 to the full open position.

Emergency Unlatching of the Side Door

It will be understood and appreciated that the aforedescribed vehicle locking and unlocking system is very convenient to the operator but relies entirely on the proper functioning of the fob 120. Thus, if the fob 120 becomes inoperative because the batteries wear out or because of water damage, the vehicle user will be unable to enter the vehicle.

In this event, the vehicle user will extract the key 114 from inside the fob 120 and use the key 114 to rotate key cylinder 112. Rotating the key cylinder 112 will unlatch the closure latch 74 and the rear closure 70 will be popped open by the force of the fork bolt spring 84 and the compression of the weather strip of the rear closure 70. Upon rotation of the fork bolt 80 of the closure latch 74, the microswitches 108 and 110 will be triggered and the control module 56 will instantly recognize that the closure latch 74 has been unlatched. The control module 56 is also monitoring the antenna 60 and knows that the antenna 60 has not received a radio signal from the fob 120. The control module 56 also knows that it has not sent a signal to the electrical actuator 98 authorizing the unlatching of the rear closure latch 74. Thus, the control module is able to calculate that the vehicle user is authorized to enter the vehicle but has not used the fob 120.

According to the invention, the control module 56, having calculated that the user is authorized, will then permit the user to enter the vehicle. In particular, when the user lifts the door handle 116, the control module 56 will energize the electrical actuator 38 of the side door latch 16 in order to unlatch the side door 8 even though the fob 120 is inoperative. In this way, the vehicle user can gain entry to the side door 8 even though the side door 8 was not equipped with a key cylinder for unlocking the side door latch 16.

Or, alternatively, the control module 56 can be programmed to immediately energize the electrical actuator 38 and unlatch the door latch 16 without waiting for the user to lift the door handle 116. In this way, the unlatching and resultant popping open of the side door 8 will signal the user that his attempt to enter has been successful.

The Flowchart

Figure 6:
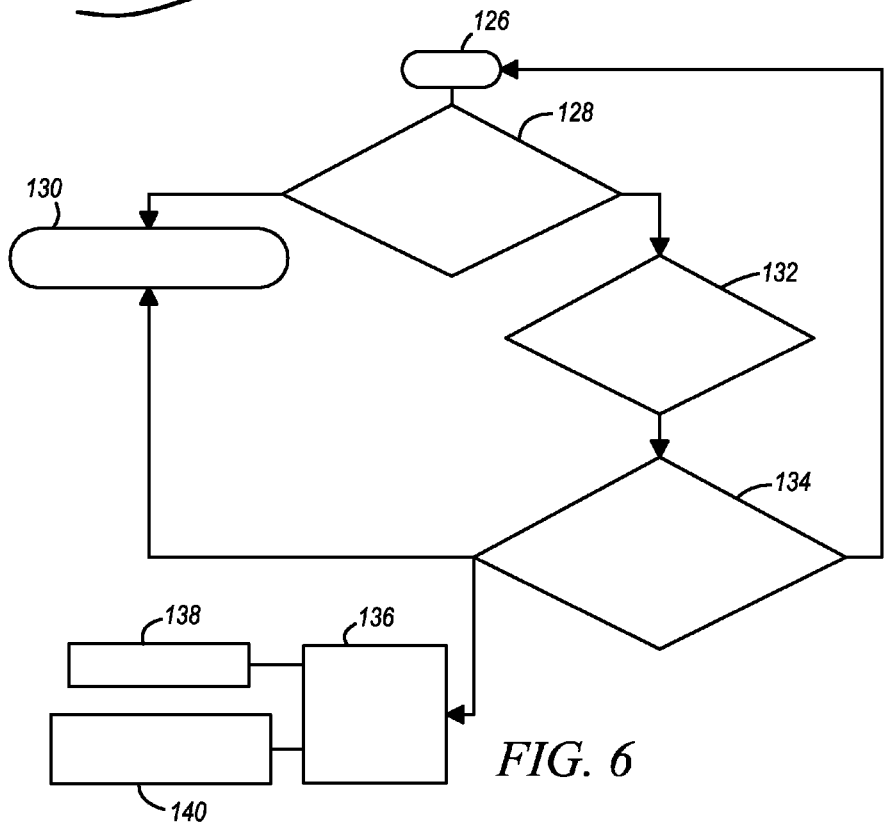
FIG. 6 is a flowchart showing the method steps by which a vehicle user can gain entry to a locked side door without the use of a remote entry fob, or a key cylinder or key pad provided on the side door.

FIG. 6 is a flowchart showing the logic method performed by the control module 56. The method starts at step 126. At step 128 the control module 56 is monitoring the radio signals received from the fob 120. If an "unlatch side door" signal is received from the fob 120, then, at step 130, the control module 56 will "unlock" and allow the lifting of the door handle 116 to unlatch the door latch 16 by energizing the electrical actuator 38.

While the control module 56 is monitoring the radio signals from the fob 120 at step 128, it is also monitoring the microswitches 108 and 110 of the rear closure latch 74. At step 132 if the rear closure latch 74 has been unlatched, then at step 134, the control module 56 looks at whether the antenna 60 has received a signal from the fob 120 and whether the control module has energized the actuator 98 to unlatch the closure latch 74. If the control module has not energized the actuator 98, then the control module 56 will calculate that the user has used the key 114 rather than the fob 120 in order to operate the rear closure latch 74. In this event, the control module 56 will recognize that the user is authorized to enter the vehicle, but has resorted to use of the key 114. Thus, knowing that the user is authorized, but there is a problem with the performance of the fob 120, the control module 56 will then proceed to step 130 and unlatch the side door latch 16.

Thus, it is seen that the control method performed by the control module 56 has two different ways to unlatch the side door 8. Under the normal method, the fob 120 will send the radio signal to the antenna 60 and instruct the control module 56 that the user is authorized, so that when the user lifts the door handle 116, the control module 56 will unlatch the door latch 16. However, the control module 56 is also monitoring the status of the closure latch 74 via the microswitches 108 and 110, and, if the closure latch 74 has been unlatched without the control module 56 having operated the electrical actuator 98, the control module 56 will know that the vehicle user has resorted to emergency use of the key 114 and respond by enabling the electrical actuator 38 so that the user can operate the door handle 116 to enter the passenger compartment.

User Notification

Referring again to FIG. 6, it is seen that control method also includes a method for notifying the vehicle user that a repair of the fob 120 is needed. Thus, in FIG. 6, at step 136, the control module 56 will initiate a notification process. For example, at step 138, the vehicle can communicate over the cellular telephone network to notify the vehicle manufacturer, or the vehicle repair facility, or the user's home computer of the need to repair or replace the fob 120. Alternatively, at step 140, the vehicle can play a pre-recorded instruction over the vehicle radio system in order to advise the vehicle user that the repair is needed.

Thus, the flow chart of FIG. 6 includes the following steps:

| Step | Action | If yes | If no |
|---|---|---|---|
| 126 | Start | | |
| 128 | Is "unlatch side door" signal being received from fob? | Go to 130 and unlock or unlatch side door | Go to 132 |
| 132 | Has rear closure latch been unlatched? | Go to 134 | Return to 126 |
| 134 | Has control module 56 energized the actuator 98 to unlatch rear closure? | Return to 126 | Go to 130 and unlock or unlatch side door, and Go to 136 |
| 136 | Perform Notification at 138 and/or 140 | | |

It will be understood that FIG. 1 shows just one example of a vehicle door latch system in which the present invention can be employed. In FIG. 1, the fob 120 has one button 122 for unlocking the side door latch 16 and one button 124 for unlatching the rear closure latch 74. The present invention can also be employed in a vehicle door latch system where the fob 120 is a "passive" fob, that is, the fob does not have a button for operating the side door latch, and instead, the fob is continuously transmitting a radio signal and will operate the side door latch in response to the distance between the fob and the vehicle. Thus, the side door latch is automatically locked when the user walks a distance from the vehicle and then automatically unlocks or unlatches when the user returns within proximity of the vehicle.

In addition, many vehicles have a keypad on the side door rather than a key cylinder. The present invention can be used to eliminate the need for either the key cylinder or a keypad on the side door the vehicle.

Furthermore, although FIG. 1 shows the example of a side door latch 16 with an electrical actuator 38, more traditional vehicle locking systems have a mechanical connection between the outside door handle and the side door latch 16 so that lifting the door handle 116 will mechanically unlatch the side door latch 16. The present invention can be used to eliminate the need for a key cylinder on these vehicles as well.

Although the embodiment of FIG. 1 has a door handle with a handle that is gripped and lifted, the invention herein can also be used on those vehicles where the door handle is a fixed grip and the door handle switch 118 is directly operated by the users hand rather than through the movement of the door handle.

Thus, the invention has provided a new and novel method for an authorized user to gain entry through the side door upon failure of a wireless key fob, even if the side door has no key cylinder or key pad.

What is claimed is:

1. A method for authorizing a user to enter a side door in a vehicle having a rear closure, comprising:
   providing the side door with a side door latch;
   providing the rear closure with a rear closure latch operable by a key operated lock cylinder;
   providing a wireless fob for transmitting a first radio signal indicating that a user is authorized to unlatch the side door latch and a second radio signal indicating that a user is authorized to unlatch the rear closure latch;
   monitoring the rear closure latch to determine whether the rear closure latch has been unlatched;
   and if the rear closure latch has been unlatched without the transmission of the second radio signal, then calculating that the key was used and the user must therefore be authorized to enter the vehicle; and permitting the user entry through the side door without transmission of the first radio signal.

2. The method of claim 1 further comprising the monitoring of the rear closure latch being performed by one or more switches operable by a position of the rear closure latch.

3. The method of claim 2 further comprising the one or more switches sensing a position of a fork bolt of the rear closure latch.

4. The method of claim 1 further comprising the side door latch having a side door latch electrical actuator, and the side door having a user actuated switch that energizes the side door latch electric actuator to unlatch the side door latch and permit opening of the door.

5. The method of claim 4 further comprising the side door having a movable door handle, monitoring the position of the door handle, and if the user has lifted the door handle, then energizing the electrical actuator to unlatch the door latch and permit opening of the door.

6. The method of claim 1 further comprising the side door latch having an electrical actuator, and energizing the electrical actuator to unlatch the door latch and permit the door to pop open.

7. The method of claim 1 further comprising upon calculating that the key was used, also calculating that the fob is inoperative and performing a notification to the user to repair the fob.

8. The method of claim 1 further comprising providing a control module monitoring the first and second radio signals and a position of the rear closure latch, and the control module controlling actuation of a side door latch actuator of the side door latch and a rear closure latch actuator of the rear closure latch.

9. The method of claim 8 further comprising the control module monitoring the position of a user actuated switch on the side door by which the user operates the side door latch to enter the vehicle.

10. The method of claim 1 further comprising monitoring the rear closure latch to determine whether the rear closure latch has been unlatched without monitoring the key operated lock cylinder.

11. A method for authorizing a user to enter a side door in a vehicle having a rear closure, comprising:

providing the side door with a side door latch having a side door electric actuator energizable to unlatch the side door latch;

providing the side door with a user operated handle switch;

providing the rear closure with a rear closure latch that is unlatched by either a key operated lock cylinder operable by a properly bitted key or by energization of an rear closure electric actuator, said rear closure latch having one or more switches operable by the unlatching of the rear closure latch;

providing a wireless fob for transmitting a first radio signal indicating that a user is authorized to unlatch the side door latch and a second radio signal indicating that the user is authorized to unlatch the rear closure latch;

monitoring the transmission of the first and second radio signals;

monitoring the one or more switches of the rear closure latch to determine that the rear closure latch has been unlatched;

monitoring the status of the handle switch;

and if the rear closure latch has been unlatched without the transmission of the second radio signal, then calculating that the key was used and the user must therefore be authorized; and upon the operation of the user operated switch on the side door, energizing the electric actuator of the side door latch to permit user entry through the side door.

12. The method of claim 11 further comprising upon calculating that the key was used, also calculating that the fob is inoperative and performing a notification to the user to repair the fob.

13. The method of claim 11 further comprising providing a control module monitoring the first and second radio signals, monitoring the position of the rear closure latch, monitoring the status of the door handle switch, and controlling actuation of the side door electric actuator of the side door latch and a rear closure electric actuator of the rear closure latch.

14. The method of claim 13 further comprising the control module calculating that if the key was used, then the fob must be inoperative and the control module then performing a notification to the user to repair the fob.

15. A method for authorizing a user to enter a side door in a vehicle having a rear closure, comprising:

providing the side door with a side door latch having an side door electric actuator energizable to unlatch the side door latch;

providing the rear closure with a rear closure latch that is unlatched by either a key operated lock cylinder operable by a properly bitted key or by energization of a rear closure electric actuator;

providing a wireless fob for transmitting a first radio signal indicating that a user is authorized to unlatch the side door latch and a second radio signal indicating that the user is authorized to unlatch the rear closure latch;

providing a control module for:

monitoring the transmission of the first and second radio signals, for enabling the energization of the side door electric actuator and the rear closure latch, and for monitoring one or more switches on the rear closure latch to determine that the rear closure latch has been unlatched;

and if the control module determines that the rear closure latch has been unlatched without the control module having enabled the energization of the rear closure latch, then calculating that the key was used and the user must therefore be authorized; and enabling the energization of the electric actuator of the side door latch to permit entry through the side door.

16. The method of claim 15 further comprising the control module calculating that if the key was used, then the fob must be inoperative and the control module then performing a notification to the user to repair the fob.

17. The method of claim 15 further comprising the side door having a user actuated switch monitored by the control module and actuation of the user actuated switch energizing the side door latch electric actuator to unlatch the side door latch and permit opening of the door.

18. The method of claim 15 further comprising the side door having a movable door handle, the control module monitoring the position of the door handle, and if the user has lifted the door handle, then energizing the electrical actuator to unlatch the door latch and permit opening of the door.

19. The method of claim 15 further comprising the control module energizing the electrical actuator to unlatch the door latch and permit the door to pop open.

* * * * *